US005553152A

United States Patent [19]

Newton

[11] Patent Number: 5,553,152

[45] Date of Patent: Sep. 3, 1996

[54] APPARATUS AND METHOD FOR MAGNETICALLY CONTROLLING A HEARING AID

[75] Inventor: James R. Newton, Burnsville, Minn.

[73] Assignee: Argosy Electronics, Inc., Eden Prairie, Minn.

[21] Appl. No.: 298,774

[22] Filed: Aug. 31, 1994

[51] Int. Cl.[6] ..... H04R 25/00

[52] U.S. Cl. ..... 381/68.6; 381/68; 623/10; 600/25; 607/57

[58] Field of Search ..... 381/68, 68.6, 69, 381/69.2, 68.3, 68.4; 600/25; 607/56, 57; 335/2, 9; 128/746; 623/10

[56] References Cited

U.S. PATENT DOCUMENTS

| | | | |
|---|---|---|---|
| 4,731,850 | 3/1988 | Levitt et al. | 381/68.4 |
| 4,756,312 | 7/1988 | Epley | 381/68.6 |
| 4,947,432 | 8/1990 | Topholm | 381/68.4 |

*Primary Examiner*—Forester W. Isen

*Assistant Examiner*—Xu Mei

*Attorney, Agent, or Firm*—Palmatier, Sjoquist & Helget, P.A.

[57] ABSTRACT

An apparatus and method for controlling a plurality of adjustable operational parameters of a hearing aid by the movement of an external magnetic actuator into and out of proximity with the hearing aid. The hearing aid has a microphone, hearing aid circuitry, an output transducer, and a magnetic switch, such as a reed switch, connected to the hearing aid circuitry. The hearing aid circuitry has a plurality of adjustable operational parameters and includes control processing circuity for switching between and controlling the adjustable operational parameters. The magnetic source is moved into and out of proximity with the hearing aid a selected number of times activating the magnetic switch each time. The control processing circuitry is configured to switch between the adjustable operational parameters on sequential activations of the magnetic switch for selection of an operational parameter to adjust the selected adjustable operational parameter after the activation of the magnetic switch is maintained a predetermined amount of time.

12 Claims, 4 Drawing Sheets

APPARATUS AND METHOD FOR MAGNETICALLY CONTROLLING A HEARING AID

BACKGROUND OF THE INVENTION

The present invention relates to hearing aids. More particularly, the invention relates to remote controlled hearing aids.

Hearing aids often offer adjustable operational parameters to facilitate maximum hearing capability and comfort to the users. Some parameters, such as volume or tone, may be conveniently user adjustable. Other parameters, such as filtering parameters, and automatic gain control (AGC) parameters are typically adjusted by the acoustician.

With regard to user adjustable parameters, it is awkward or difficult to remove the hearing aid for adjustment especially for individuals with impaired manual dexterity. Remotely controlled units may be utilized to adjust such desired functions inconspicuously and without removal of the hearing aid.

Various means have been utilized for the remote control of hearing aids. A remote actuator of some type is necessarily required for all remote controlled systems. Control signals from the remote actuator have been by way of several different types of media such as infrared radiation, ultrasonic signals, radio frequency signals, and acoustical signals.

Often times different listening situations will warrant different settings of various adjustable parameters for optimal hearing and comfort. This need may be addressed by preprogramming various groups of settings (programs) of the parameters into the memories of the hearing aids. When entering a different environment the user can select the most suitable group of settings of the adjustable parameters. The remote control selection of such programs has heretofore required transmission of coded or modulated signals to activate selection of the desired programs. This necessitating an electrically complex remote actuator and receiver circuitry in the hearing aid. Obviously, where a remote actuator is inoperable or unavailable, selection of different programs would be impossible.

Remote actuators used to control parameters and select programs can have complicated controls which can make them difficult to understand and use by many hearing aid users. Moreover, users with limited manual dexterity due to arthritis, injuries, or other debilitating illnesses, may find it difficult or impossible to operate remote controls with several push-button controls. Thus, there is a need for a simple to use remote controlled hearing aid requiring very limited manual dexterity and in which a number of hearing aid parameters may be controlled, either individually or by way of program selections.

As hearing aids have become more sophisticated they have also become smaller. "Completely in the canal" (CIC) hearing aids are currently available which are miniaturized sufficiently to fit far enough into the ear canal to be out of view. Such placement makes the hearing aid difficult to access with tools for adjusting the operational parameters. Moreover, such placement makes remote control where direct access is needed, such as infrared radiation, difficult or impossible.

In such state of the art hearing aids there is minimal faceplate space for sensors or controls such a potentiometers. Thus there is a need for a means of controlling adjustable operational parameters in state of the art miniaturized hearing aid without controls or sensors that take up faceplate space.

SUMMARY OF THE INVENTION

An apparatus and method for controlling a plurality of adjustable operational parameters of a hearing aid by the movement of an external magnetic actuator into and out of proximity with the hearing aid. The external actuator is hand held and comprises a magnetic source such as a permanent magnet. The hearing aid has a microphone for generating signals, hearing aid circuitry for processing the signals, an output transducer for transforming the processed signals to a user compatible form, and a magnetic switch, such as a reed switch, connected to the hearing aid circuitry. The hearing aid circuitry has a plurality of adjustable operational parameters and includes control processing circuity for switching between and controlling the adjustable function modes. The magnetic source is moved into and out of proximity with the hearing aid a selected number of times activating or switching "on" the magnetic switch each time. The control processing circuitry is configured to switch between the adjustable operational parameters on sequential activations of the magnetic switch for selection of an operational parameter to adjust. The control processing circuity is further configured to adjust the selected adjustable operational parameter after the activation of the magnetic switch is maintained a predetermined amount of time. The control processing circuitry is configured to adjust the function at a predetermined rate while the magnetic source is maintained in said proximity.

In an alternate embodiment, various sets of specific settings of the adjustable parameters may be programmed into a memory contained in the hearing aid circuitry in the form of a plurality of programs. The various programs may be selected by rotating through the programs by sequentially activating the magnetic switch by moving the actuator into and out of proximity with the hearing aid.

A feature of the invention is that the circuitry required in the hearing aid is quite limited in comparison to alternative remote control devices. The invention utilizes a simple logic level input, that is, a simple on-off switch as compared to modulated infrared radiation and RF signals that require detection, amplification, and decoding.

A feature of the invention is that the magnetic actuator utilizes no electrical circuitry, no electrical components, no batteries, and no moving parts. As a result, the magnetic actuator offers a very high level of reliability, is very durable, has a very long service life, and is essentially maintenance free.

A further object and advantage of the invention is that the remote actuator is small and inconspicuous, may be easily carried in a pocket.

A further object and advantage of the invention is that if the remote actuator is unavailable, substitute magnets may be utilized for adjusting the device.

A further object and advantage of the invention is that the system is essentially immune from sources of interference which can create difficulties for systems utilizing RF, infrared, or ultrasonic remote control.

An additional object and advantage of the invention is that the device needs a minimal amount of manual dexterity to adjust the operational parameters. The actuator only needs to be moved into proximity with the reed switch and maintained within said proximity to adjust the operational parameters.

An additional object and advantage of the invention is that the device need not be removed from the ear for the adjustment of the adjustable operational parameters. Moreover, no adjustment tools need be inserted into the ear for the said adjustment. Nor does the device need to be visually or physically accessible to adjust the parameters.

An additional object and advantage of the invention is that control of operational parameters in the hearing aid is accomplished without the use of conventional potentiometers and switches.

An additional object and advantage of the invention is that a wide variety of operational parameters may be controlled by the external magnetic actuator.

DETAILED DESCRIPTION OF THE PREFERRED EMBODIMENTS

Figure 1:
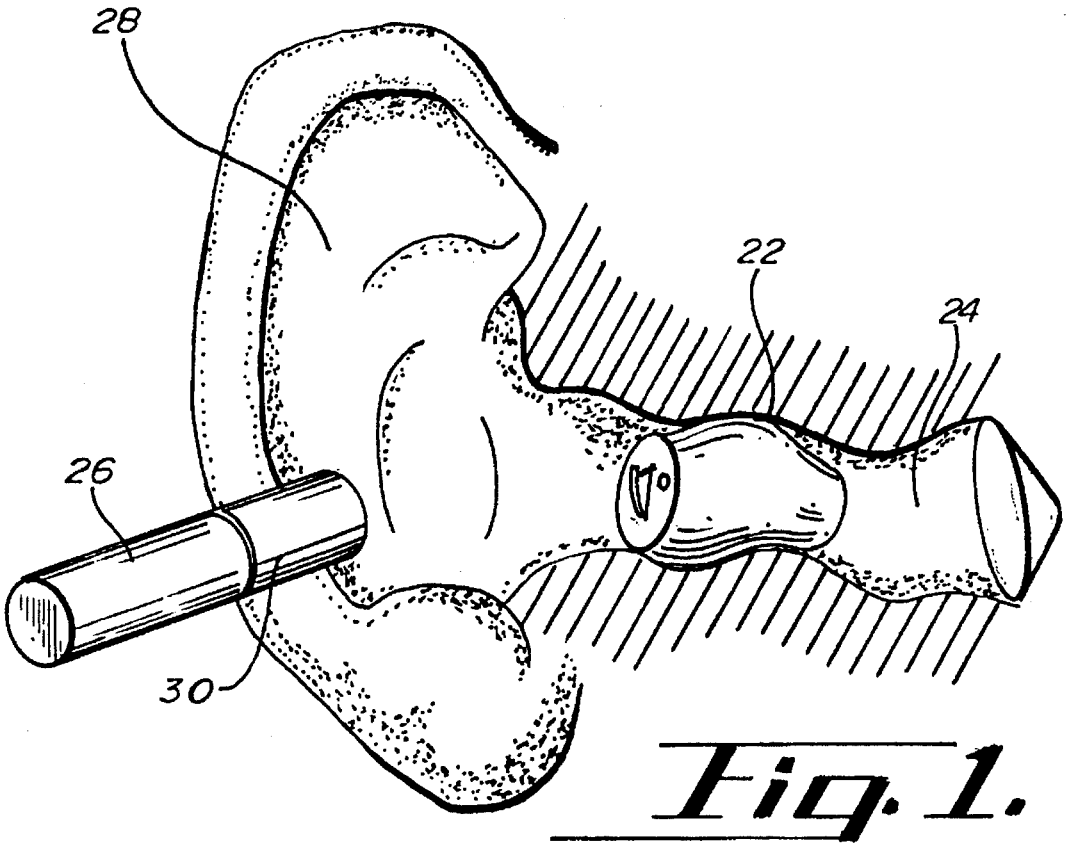
FIG. 1 is a partial sectional view showing a completely in the canal (CIC) hearing aid system in place which incorporates the invention.

Referring to FIG. 1, a preferred embodiment of the invention is depicted. The invention is a hearing aid system which principally comprises a hearing aid 22 which is shown in place in an ear canal 24 and a magnetic actuator 26 shown in an actuating position at the ear pinna 28. As described below the hearing aid 22 has a plurality of adjustable operating parameters. The magnetic actuator 26 includes a magnet portion 30. The hearing aid as depicted is configured as a "completely in the canal" (CIC) type. The invention may also be embodied in the other convention configurations of hearing aids such as "in the ear", "in the canal", "behind the ear", the eyeglass type, body worn aids, and surgically implanted hearing aids. Due to the extreme miniaturization of CIC hearing aids, the features of the invention are particularly advantageous in this type of aid.

Figure 2:
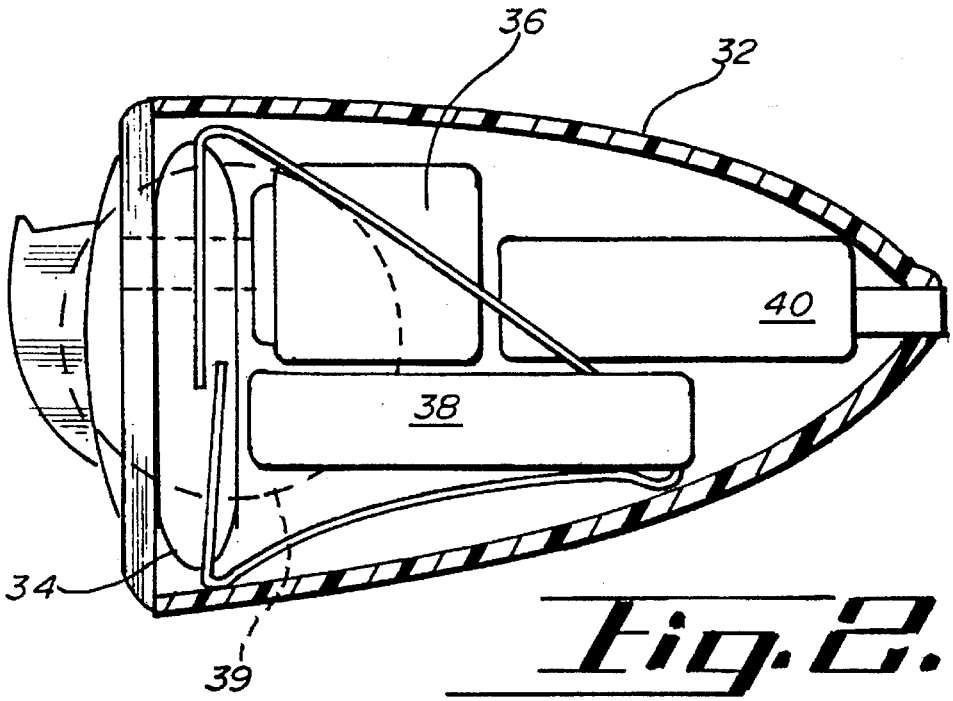
FIG. 2 is a partial sectional view showing one embodiment of a CIC hearing aid incorporating the invention.

FIG. 2 shows a crossesectional view of the CIC hearing aid 22. The hearing aid 22 includes a housing 32, a magnetic switch shown as a reed switch 34, a microphone 36, hearing aid circuitry 38, a battery 39 and a receiver 40.

Figure 3:
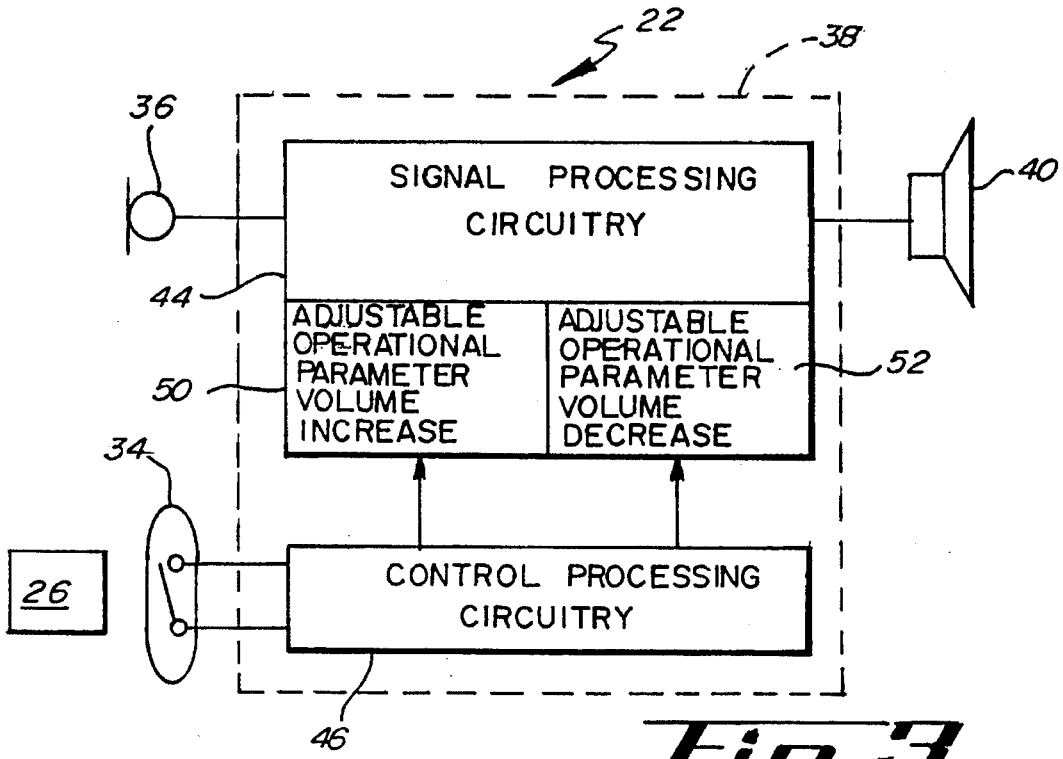
FIG. 3 shows a block diagram of one embodiment of the invention.

FIG. 3 shows a block diagram of one embodiment of the invention. In this embodiment the remote actuator controls volume increase and volume decrease. The hearing aid circuitry 38 comprises signal processing circuitry 44 and control processing circuitry 46. The signal processing circuitry 44 receives electrical signals generated by the microphone 36 and processes the signals as desired. Such processing would typically include amplification, filtering, and limiting. The processed signals are transmitted to the receiver 40. The signal processing includes a plurality of adjustable parameters 50, 52 identified in this embodiment as volume increase and volume decrease. The control processing circuitry 46 is connected to the magnetic switch 34 and translates actuations of the magnetic switch into control signals to adjust the adjustable operational parameters volume increase 50 and volume decrease 52. The control processing circuitry 46 is configured to switch between and adjust the operational parameters 50, 52 based upon the actuation of the magnetic switch and the maintenance of the actuation. This is accomplished by movement of the magnetic actuator into proximity of the hearing aid and holding the actuator in said proximity. A suitable circuit corresponding to the block diagram of FIG. 3 is shown in FIG. 5 and discussed below.

The embodiment of FIG. 3 utilizes volume increase 50 and volume decrease 52 as the adjustable operational parameters. In other configurations, volume could be a single operational parameter, where used herein, volume and gain are synonymous. Numerous other adjustable operational parameters are available to control.

Figure 4:
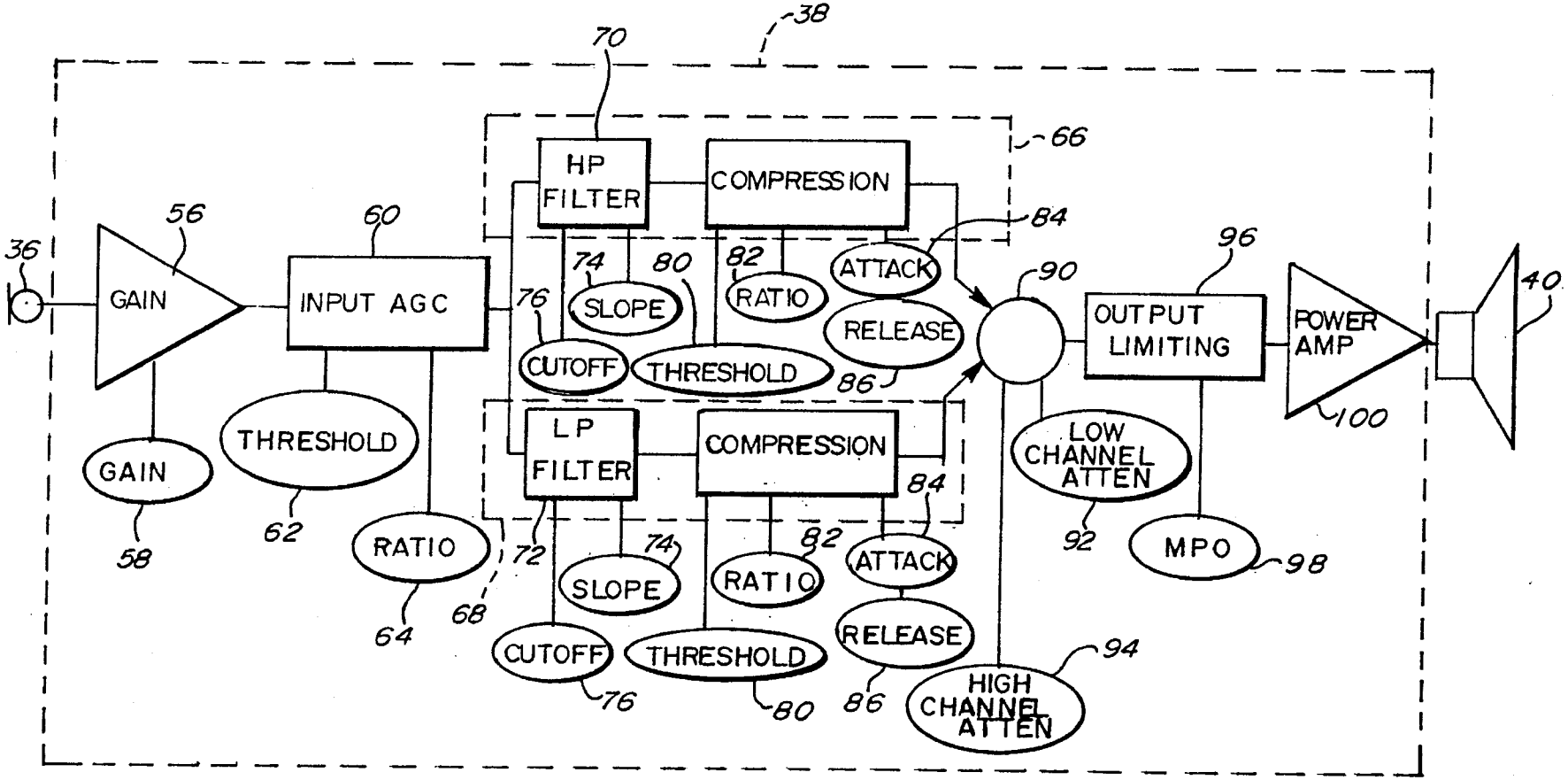
FIG. 4 shows a block diagram of a modern hearing aid with available adjustable operational parameters.

FIG. 4 exemplifies the adjustable operational parameters that are available in a modern hearing aid. FIG. 4 is a block diagram of the signal processing circuitry 44 which includes a number of circuit segments providing operational functions with associated adjustable operational parameters. It is not anticipated that all of the operational parameters shown in FIG. 4 would be adjustable in any particular hearing aid. Suitably, a select number of operational parameters would be selected for adjustment capabilities in a hearing aid. The signal from the microphone 36 goes to a preamp 56 in which the gain 58 is available as an adjustable parameter. The signal then goes to a input automatic gain control (AGC) 60 in which the threshold 62 and the AGC ratio 64 are available as adjustable parameters. The output from the AGC is split into two channels, a high channel 66 and a low channel 68. The high channel 66 has a high-pass filter 70 with available adjustable parameters of cutoff 74 and slope 76, and an AGC-compression circuit 78 with available adjustable parameters of threshold 80, ratio 82, attack time 84, and release time 86. The low channel 68 has analogous functions and available adjustable operational parameters. The high channel 66 signal and low channel 68 signal are combined in a summer 90 with available adjustable functions of low channel attenuation 92 and high channel attenuation 94. The signal then goes to the final power amplifier 100 having maximum power output 98 available as an adjustable parameter. Volume or gain control 102 is available on the line 104 to the power amplifier 100. The final power amplifier 100 amplifies the signal for the outputs transducer 40.

Figure 5:
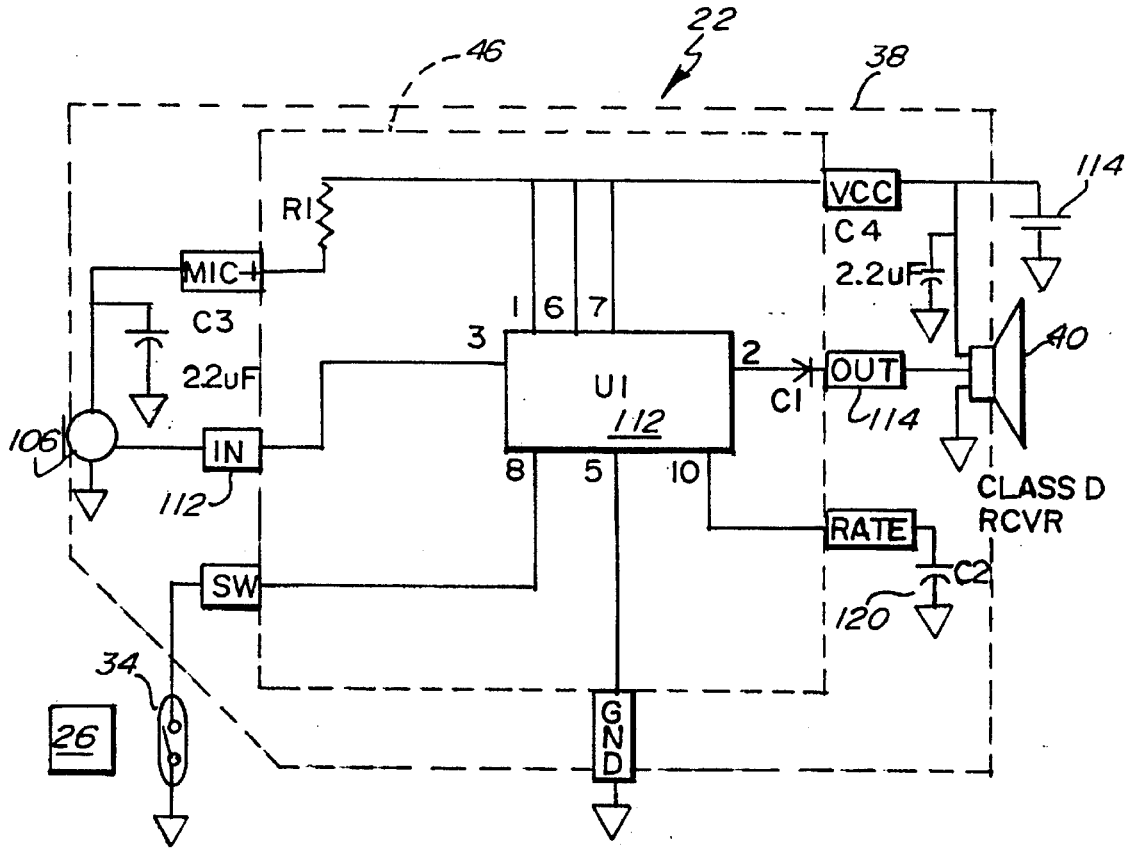
FIG. 5 shows a schematic diagram of the embodiment of the invention shown in FIG. 3.

FIG. 5 shows a schematic diagram of the embodiment of the hearing aid 22 of FIG. 3. The hearing aid 22 utilizes a conventional hearing aid microphone 106 which includes a preamp mounted within the microphone enclosure and a Class D receiver 108 which comprises a Class D amplifier included with an earphone. Therefore, the hearing aid circuitry 38, identified by the dashed lines is shown extending through the microphone 106 and the receiver 108. Such microphones and receivers are available from Knowles Electronics, Itasca, Ill. The control processing circuitry is comprised of an integrated circuit chip 112 which controls the volume increase and the volume decrease. A battery 114 provides power to the microphone 106, the Class D receiver 108 and the IC chip 112.

The volume is increased and decreased by varying the impedance of the IC through the IC input 116 at (pin 3) and the IC output 118 (pin 2). The IC 112 is suitably a GT560 transconductance block manufactured by the Gennum Corporation. Details regarding the design and operating specifications are available in the GT560 Data sheet available from Gennum Corporation, P.O. Box 489, Station A, Burlington, Ontario, Canada L7R 3Y3.

The IC chip 112 is configured whereby the impedance is increased or decreased dependent upon the sequencing and duration of the shorting of the pin 8 to ground which is accomplished through the actuation of the magnetic switch 34. Upon shorting of the pin 8, the volume decrease (or increase) does not commence for a predefined period of time determined by the value of the capacitor 120. An appropriate period of time would be one to two seconds. The embodiment of FIG. 5 operates as follows:

The magnetic actuator 26 is moved into proximity of the hearing aid 22 and thus the magnetic switch 34, actuating the switch 34. When used herein "into proximity" refers to the range from the hearing aid in which the magnetic actuator will actuate the magnetic switch. The magnetic actuator 26 is maintained in proximity to said switch for a period of time after which the impedance is ramped upwardly at a predetermined rate resulting in a volume decrease. The increase in impedance (and decrease in volume) continues as long as the magnetic actuator 26 is maintained win proximity to the magnetic switch 34 until the maximum impedance of the IC chip 112 is reached. If the magnetic actuator 26 is moved out of proximity with the magnetic switch 34, the increase in impedance freezes at whatever point it is currently at. When the magnetic actuator 26 is returned to proximity with the magnetic switch 34 the impedance commences ramping downwardly, increasing the volume until the magnetic actuator 26 is moved out of proximity or until the minimum impedance is reached. Thus, the sequential movement of the magnetic actuator 26 into and out of proximity with the hearing aid 22 alternates the control processing circuitry 46 between the two adjustable operational parameters of volume decrease and volume increase. Holding the magnetic actuator 26 within the proximity of the hearing aid increases or decreases the volume dependent upon which operational parameter is selected.

Figure 6:
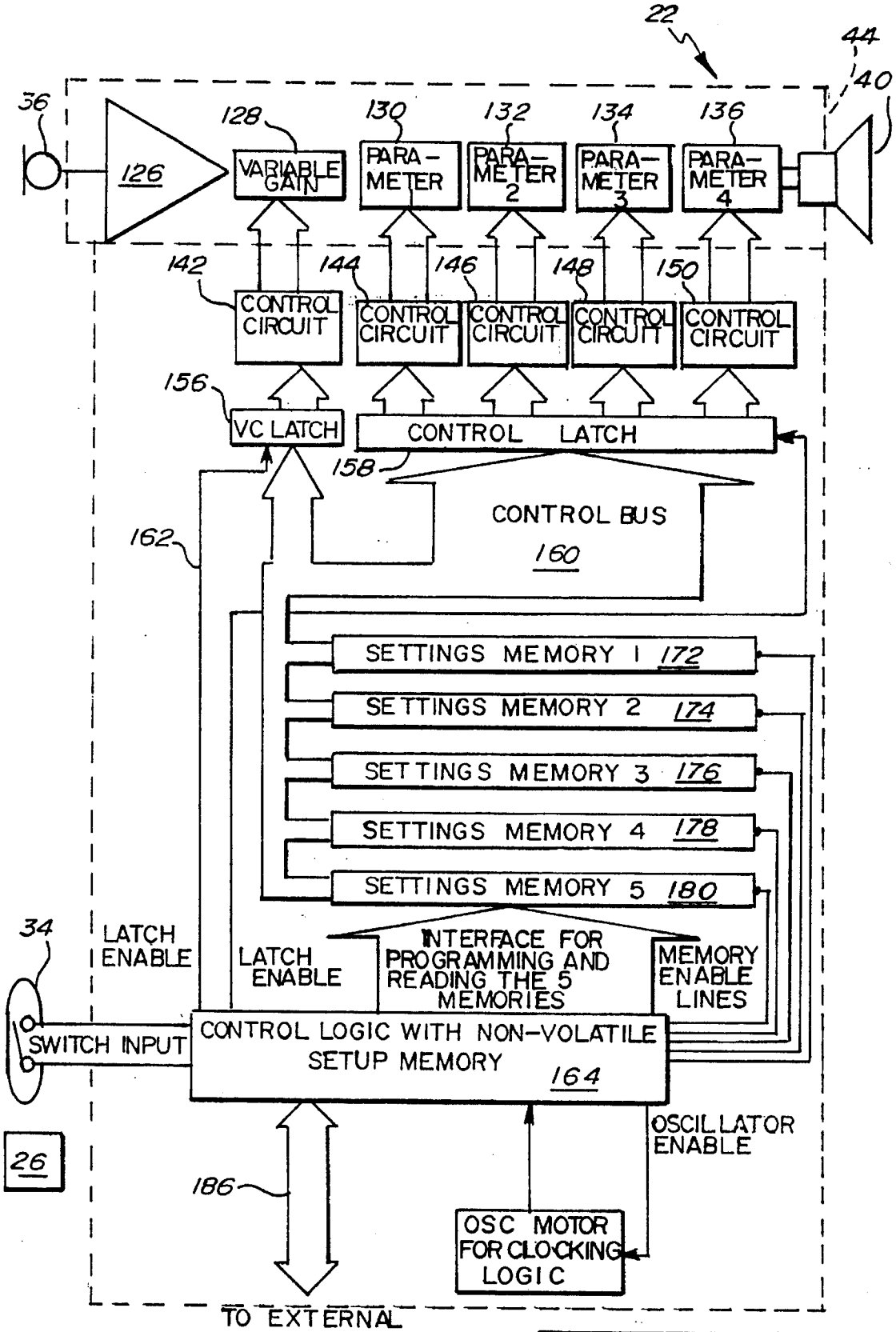
FIG. 6 shows a block diagram of an additional embodiment of the invention.

An additional embodiment is shown by way of a block diagram in FIG. 6. In this embodiment the user may, through use of the magnetic actuator, adjust the volume of the aid and select any of five different programs for different listening environments. Each of the five programs provide for separate settings for five adjustable parameters including volume control. The programs are groups of settings of the adjustable operational parameters that would typically be preprogrammed into the hearing aid 22 by the acoustician through an appropriate interface. The adjustable parameters could be any of the parameters shown in FIG. 4.

Continuing to refer to FIG. 6, this embodiment has a microphone 36, a receiver 40, a magnetic switch 34, and hearing aid circuitry 38. The hearing aid circuitry 38 includes signal processing circuitry 44, and control processing circuitry 46. The signal processing circuitry 44 has an amplifier 126 and volume control or variable gain 128 as an adjustable operational parameter along with four other adjustable operational parameters 130, 132, 134, 136 which may be such as those discussed with reference to FIG. 4 above. The control processing circuitry 46 includes five control circuitry blocks 142, 144, 146, 148, 150 which translate a digital control word from the volume control (VC) latch 156 or control latch 158 to switch closures or to adjust a discrete electrical analog quantity required to change the signal processing action of the respective adjustable operational parameters 128, 130, 132, 134, 136. The control circuitry blocks 142, 144, 146, 148, 150 are of conventional design utilizing digital control logic to provide the specific control settings for each adjustable parameter. Such control logic is familiar to those skilled in the art and will therefore not be further detailed.

In the embodiment of FIG. 6, the volume control is the only operational parameter that the user can independently adjust. Initial volume settings are programmed into each setting memory by the acoustician. Thereafter, toggling the latch enable 162 through the control logic controls the volume gain 128.

Each settings memory 172, 174, 176, 178, 180 contains a digital word that translates into a group of settings of the adjustable operational parameters 128, 130, 132, 134, 136. These memories are suitably read and loaded by an external programmer, not shown, which interfaces with the control logic 164 by way of a programming interface 186. The programming interface 186 may be through various known means such as hard wire, RF or infrared radiation, acoustic or ultrasonic signals. Ideally the settings memories 172, 174, 176, 178, 180 should be nonvolatile, to maintain their contents in the absence of battery power.

The control logic coordinates the system function by interfacing the external programmer to settings memories; sequencing, selecting and transferring a settings memory to the control latch 158; sequencing and transferring control words to the VC latch 156; reading the switch input 188 from the magnetic switch 34; timing human and programmer interface operation; and preserving the volume control setting and settings memory address in use at power down and transferring these control words to the appropriate latches at power-on.

The control bus 160 carries the digital word from the selected settings memory to the VC latch 156 and control latch 158.

The details of the hearing aid circuitry and the programming of the control logic would be apparent to those skilled in the art and therefore need not be explained in greater detail. Although the exact operating procedure may obviously vary with the programming of the control logic, the embodiment of FIG. 6 could be configured to operate as follows:

The user turns on the aid 22. The aid powers up in the state it was in when it was turned off. At power on the aid 22 comes up in volume control mode. To adjust the volume, the user brings the magnetic actuator 26 into proximity with the magnetic switch 34. Continuing to hold the magnetic actuator 26 in proximity (holding the switch closed) for a predefined period of time will begin to change the volume. The control circuitry can be configured such as to ramp the volume up to maximum volume and then to ramp the volume down. The volume ramping ceases when the user moves the magnetic actuator 26 out of proximity. Unless the user specifically accesses the change memory mode, the aid 22 always stays in volume control mode. To change the program in use, the magnetic actuator 26 is brought into proximity with the switch 34 and then removed from said proximity before the lapse of the predefined period of time. The aid 22 will then switch to the next program and the corresponding settings of the adjustable operational parameters. If the magnetic actuator 26 is again moved into proximity and immediately removed, the hearing aid 22 will rotate or switch to the next group of settings in the next setting memory.

Although the magnetic switch 34 has been depicted as a reed switch, other types of magnetic sensors are anticipated and would be suitable for this invention. Such sensors would include hall effect semiconductors, magneto-resistive sensors, and saturable core devices. Where used herein, magnetic switch is defined in include such sensors. Similarly, the magnetic actuator maybe any magnetic source such as a permanent magnet or an electromagnet.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A hearing aid system comprising:

a) a magnetic actuator for utilization external the ear;

b) a hearing aid sized for placement substantially within an ear canal, comprising:

i) a microphone for generating electrical signals from acoustical input;

ii) an output transducer earphone for transforming processed electrical signals into a user compatible form; and iii) hearing aid circuity connected to the microphone and the output transducer, the hearing aid circuitry comprising signal processing circuitry and control processing circuitry, the signal processing circuitry configured for processing said electrical signals generated by the microphone, the signal processing circuitry including a plurality of adjustable operational parameters, iv. a single magnetic switch actuatable by the magnetic actuator, when said actuator is moved into proximity with the hearing aid, the actuator and switch sized such that, with the hearing aid in the ear canal, the magnetic switch is actuatable by the actuator positioned exterior of the ear canal, the single magnetic switch connected to the hearing aid circuity, the control processor circuitry configured to sense actuation of the single magnetic switch and to switch between and adjust the operational parameters exclusively by the actuation of the single magnetic switch whereby said adjustable operational parameters may be adjusted exclusively by moving the magnetic actuator into and out of proximity with the hearing aid without insertion into the ear canal and without contacting the hearing aid.

2. The system of claim 1, whereby the control processing circuitry is configured to switch between the adjustable operational parameters upon sequential actuations of the magnetic switch thereby selecting an operational parameter for adjustment, the control processing circuitry further configured to adjust said selected operational parameter after the actuation of the magnetic switch has been maintained for a predefined amount of time.

3. The system of claim 2, wherein one adjustable operational parameter is volume increase and an additional operational parameter is volume decrease.

4. The system of claim 2, wherein the hearing aid is a completely in the canal type of hearing aid.

5. A hearing aid for placement completely-in-the-ear-canal and controllable by a magnetic actuator external to the ear canal, the hearing aid comprising:

a housing sized to be worn completely within an ear canal, b) a microphone for generating electrical signals from acoustical input;

c) a magnetic sensor actuatable by the magnetic actuator when said actuator is moved into proximity with the hearing aid and external the ear canal;

d) a transducer for transforming processed electrical signals into a user compatible form;

e) hearing aid circuity connected to the microphone, the output transducer, and the magnetic switch, the hearing aid circuitry, the microphone, the magnetic sensor, the transducer, and the hearing aid circuitry all contained by the housing, the hearing aid circuitry comprising a volume control with a range of settings, the hearing aid circuitry configured to adjust the volume control through the range of settings exclusively by the actuation of the single magnetic sensor, the magnetic sensor configured to be actuatable by the magnetic actuator held external to the ear.

6. A combination hearing aid and external magnetic actuator, the hearing aid comprising:

a) a microphone for generating electrical signals from acoustical input;

b) a magnetic switch actuatable by the magnetic actuator when said actuator is moved into proximity to but not in contact with the hearing aid;

c) an output transducer for transforming processed electrical signals into a user compatible form;

d) hearing aid circuity connected to the microphone, the output transducer, and the magnetic switch, the hearing aid circuitry comprising signal processing circuitry and control processing circuitry, the signal processing circuitry configured for processing said electrical signals generated by the microphone, the signal processing circuitry having a plurality of adjustable operational parameters, the control processing circuitry comprising a plurality of memories for storing groups of settings of the operational parameters, the control processor circuitry configured to sense actuation of the magnetic switch and independently adjust at least one operational parameter and to switch among the plurality of memories dependant exclusively upon actuations of the magnetic switch.

7. The combination of claim 6, wherein the control processing circuitry is configured to switch among the plurality of memories upon sequential actuations of the magnetic sensor.

8. The combination of claim 7, wherein the output transducer, the microphone, the magnetic switch and the hearing aid circuitry are contained within a housing, the housing configured to be inserted into the ear canal.

9. A hearing aid system comprising:

a) an external magnetic actuator;

b) a hearing aid sized to be worn substantially within the ear canal, the hearing aid comprising:

i) a microphone for generating electrical signals from acoustical input;

ii) a magnetic switch actuatable by the magnetic actuator when said actuator is moved into proximity with the hearing aid and external the ear canal;

iii) an output transducer for transforming processed electrical signals into a user compatible form;

iv) hearing aid circuity connected to the microphone, the output transducer, and the magnetic switch, the hearing aid circuitry comprising signal processing circuitry and control processor circuitry, the signal processing circuitry configured for processing said electrical signals generated by the microphone, the processing of said signals including a plurality of adjustable operational parameters, the control processor circuitry configured to adjust said selected operational parameter after the actuation of the magnetic switch has been maintained for a predetermined amount of time, the control processor circuitry further configured to sense sequential actuations of the magnetic switch and to switch between the adjustable operational parameters upon sensing of said sequential actuations thereby selecting a operational parameter for adjustment.

10. The hearing aid system of claim 9, the output transducer, the microphone, the magnetic switch and the hearing aid circuitry are contained within a shell, the shell configured to be inserted into the ear canal.

11. The hearing aid system of claim 10, wherein the hearing aid is a completely in the canal type of hearing aid.

12. A method of switching between a plurality of groups of operational parameter settings in a programmable hearing aid, the method comprising:

a) programming the hearing aid with a plurality of groups of adjustable parameter settings;

b) configuring the hearing aid to rotate through the groups of settings in response to signals received by a magnetic sensor in the hearing aid:

c) generating a signal by moving a magnetic actuator into and out of proximity with the hearing aid whereby the magnetic sensor senses the proximity of the actuator and causes the hearing aid to rotate to the next group of adjustable parameter settings.

* * * * *

UNITED STATES PATENT AND TRADEMARK OFFICE

CERTIFICATE OF CORRECTION

PATENT NO. : 5,553,152
DATED : September 3, 1996
INVENTOR(S) : James R. Newton

It is certified that error appears in the above-indentified patent and that said Letters Patent is hereby corrected as shown below:

Column 3, line 49, please delete the word "crossesectional" and insert in its place --cross sectional--.

Column 5, line 19, please delete the word "win" and insert in its place --in--.

Column 7, line 58, before the word "a" please insert --a)--.

Signed and Sealed this

Third Day of December, 1996

Bruce Lehman

*Attest:*

BRUCE LEHMAN

*Attesting Officer*

*Commissioner of Patents and Trademarks*